United States Patent [19]

Welch

[11] 4,135,995

[45] Jan. 23, 1979

[54] METHOD OF ELECTROLYSIS, AND ELECTRODE FOR THE ELECTROLYSIS

[75] Inventor: Cletus N. Welch, Clinton, Ohio

[73] Assignee: PPG Industries, Inc., Pittsburgh, Pa.

[21] Appl. No.: 878,630

[22] Filed: Feb. 17, 1978

[51] Int. Cl.[2] ..... C25B 1/04; C25B 11/12

[52] U.S. Cl. ..... 204/98; 204/128; 204/129; 204/294

[58] Field of Search ..... 204/294, 128, 98, 129

[56] References Cited

U.S. PATENT DOCUMENTS

| | | | |
|---|---|---|---|
| 3,397,087 | 8/1968 | Yoshizawa et al. | 204/294 |
| 3,536,532 | 10/1970 | Watanabe et al. | 136/83 |
| 3,567,618 | 3/1971 | Foulletier et al. | 204/294 |
| 4,052,539 | 10/1977 | Shropshire et al. | 429/194 |
| 4,074,019 | 2/1978 | Malachesky et al. | 429/50 |

*Primary Examiner*—R. L. Andrews

*Attorney, Agent, or Firm*—Richard M. Goldman

[57] ABSTRACT

Disclosed is a method of conducting electrolysis by passing an electrical current from an anode through an aqueous electrolyte to a cathode where the cathode is an intercalation compound of carbon and fluorine.

19 Claims, No Drawings

METHOD OF ELECTROLYSIS, AND ELECTRODE FOR THE ELECTROLYSIS

DESCRIPTION OF THE INVENTION

In the process of producing alkali metal hydroxide and chlorine by electrolyzing an alkali metal chloride brine, such as an aqueous solution of sodium chloride or potassium chloride, the alkali metal chloride solution is fed into the cell, a voltage is imposed across the cell, chlorine is evolved at the anode, alkali metal hydroxide is produced in the electrolyte in contact with the cathode, and hydrogen may be evolved at the cathode. The overall anode reaction is:

$$2Cl^- \rightarrow Cl_2 + 2e^- \quad (1)$$

while the overall cathode reaction is:

$$2H_2O + 2e^- \rightarrow H_2 + 2OH^-. \quad (2)$$

More precisely, the cathode reaction is reported to be:

$$H_2O + e^- \rightarrow H_{ads} + OH^- \quad (3)$$

by which the monatomic hydrogen is adsorbed onto the surface of the cathode. In basic media, the adsorbed hydrogen is reported to be desorbed according to one of two alternative processes:

$$2H_{ads} \rightarrow H_2, \text{ or} \quad (4)$$

$$H_{ads} + H_2O + e^- \rightarrow H_2 + OH^-. \quad (5)$$

The hydrogen desorption step, i.e., reaction (4) or reaction (5), is reported to be the hydrogen overvoltage determining step. That is, it is the rate controlling step and its activation energy corresponds to the cathodic hydrogen overvoltage. The cathode voltage for the hydrogen evolution reaction (2) is on the order of about 1.5 to 1.6 volts versus a saturated calomel electrode (SCE) on iron in basic media of which the hydrogen overvoltage component is about 0.4 to 0.5 volt.

One method of reducing the cathode voltage is to provide a substitute reaction for the evolution of gaseous hydrogen, that is, to provide a reaction where a liquid product is formed rather than gaseous hydrogen. Thus, water may be formed where a porous carbon or graphite cathode is used and an oxidant is fed to the cathode. The oxidant may be a gaseous oxidant such as oxygen, carbon monoxide, or the like. Alternatively, the oxidant may be a liquid oxidant such as hydrogen peroxide or a peroxy acid or the like.

One problem encountered in the use of a porous carbon cathode including porous graphite cathodes and porous carbon cathodes having electrocatalytic materials deposited on the surface thereof and within the pores thereof, is that the porous carbon is attacked by the catholyte liquor. It has now been found, however, that a particularly desirable cathode useful in carrying out reactions where a liquid co-product is produced rather than gaseous hydrogen may be provided by a solid intercalation compound of carbon and fluorine in the form of a porous structure.

DETAILED DESCRIPTION OF THE INVENTION

Disclosed is a method of carrying out electrolysis by passing an electrical current from an anode through an aqueous electrolyte to a cathode where the cathode comprises an intercalation compound of carbon and fluorine. Most commonly, the electrolysis will be the electrolysis of aqueous alkali metal chloride brines where an electrical potential is imposed across the anode and cathode whereby an electrical current passes from the anode of an electrolytic cell to the cathode of the cell, evolving chlorine at the anode.

According to the disclosed method, the cathode has a hydrophilic portion formed of a solid intercalation compound of fluorine and carbon in contact with the aqueous electrolyte. According to a preferred exemplification, the cathode also has a hydrophobic portion in contact with the gas within the electrolytic cell, whereby an oxidant may be fed to the hydrophobic portion in order to form a liquid co-product thereby avoiding the evolution of hydrogen. According to a further preferred exemplification of the method of this invention, the cathode has a hydrophilic portion formed of an intercalation compound of carbon and fluorine in contact with the aqueous electrolyte and a hydrophobic portion in contact with the gas. Thus, there is provided a cathode having a surface of an intercalation compound of carbon and fluorine in contact with an aqueous alkaline liquor, for example, an aqueous alkaline liquor containing alkali metal ion such as potassium ions or sodium ions and the hydrophobic portion of the cathode in contact with gas, which gas contains an oxidizing material such as oxygen.

Further disclosed herein is a method of electrolyzing an aqueous alkali metal halide brine by passing an electrical current from an anode in aqueous alkali metal halide brine through the aqueous alkali metal halide brine to a permeable barrier, thence through the permeable barrier to an aqueous alkaline electrolyte and through an aqueous alkaline electrolyte to a cathode which is in contact with the aqueous alkaline electrode. A halogen gas is recovered from the anode and an aqueous solution containing alkali metal hydroxide is recovered from the catholyte liquor. According to the method herein described, the cathode comprises a solid intercalation compound of carbon and fluorine. According to a preferred exemplification of the method of this invention, the alkali metal halide is preferably sodium chloride or potassium chloride.

According to a still further exemplification of this invention, there is disclosed a cathode having a current carrier, a first surface portion on said current carrier having as a portion thereof a solid intercalation compound of carbon or fluorine, and a second hydrophobic portion on the current carrier.

By an intercalation compound of carbon and fluorine is meant a carbonaceous material crystallized in a graphitic layer lattice with the layer atoms being approximately 1.41 angstroms apart, the layers being a greater distance apart, e.g., at least about 3.35 angstroms, and with fluorine atoms present between the layers. As herein contemplated, the carbon layers within the intercalation compound may be puckered, as postulated for carbon monofluoride having the empirical formula ($CF_x$) where x is between 0.68 and 0.995. Alternatively, the carbon layers within the intercalation compound may be substantially planar, as postulated for tetracarbon monofluoride having the empirical formula ($CF_x$) where x is between 0.25 and 0.30. Also contemplated herein are various intermediate and non-stoichiometric compounds.

Intercalation compounds of carbon and fluorine are also referred to as fluorinated graphites and graphite fluorides. They are characterized by an infrared spectrum showing an absorption band at 1220 centimeters$^{-1}$.

Intercalation compounds of carbon and fluorine may be prepared by reacting graphite with a Lewis acid fluoride and chlorine trifluoride in the presence of hydrogen fluoride. The Lewis acid is a Lewis acid fluoride of an element selected from boron, silicon, germanium, tin, lead, phosphorous, arsenic, antimony, bismuth, titanium, zirconium, hafnium, vanadium, columbium, and tantalum. Particularly preferred Lewis acid fluorides are arsenic trifluoride, boron trifluoride, and phosphorous pentafluoride. The porous structure intercalation compounds of carbon and fluorine are prepared by first cooling graphite and hydrogen fluoride, e.g., to −80° C. The Lewis acid fluoride in chlorine trifluoride is then slowly charged to the reactor in an equimolar ratio and the reaction medium is allowed to gradually increase in temperature. Further additions of the acid fluoride and the chlorine trifluoride are made until the reaction has gone substantially to completion and the Lewis acid fluoride and chlorine trifluoride are present in the vapor phase.

According to an alternative method of synthesis, the intercalation compound may be prepared by charging dried graphite powder or carbon black to a reactor, e.g., a static bed reactor or a fluidized bed reactor. Thereafter, fluorine, diluted with an inert gas such as argon or nitrogen, may be fed to the reactor and the reactor maintained at elevated temperature from about 300° C. to about 620° C. for from about 5 to about 20 hours whereby to form the intercalation compound. Thereafter, the reactor is allowed to cool to under 200° C. and then flushed with nitrogen. Additionally, the method described above may be used with graphite cloth, graphite pellets, and graphite rods.

Preferably, when the intercalation compound is prepared as described above, the temperature of the reaction is from about 315° C. to about 530° C.

The intercalation compound as preferred herein has the general formula ($CF_x$) where x is from about 0.25 to about 1.00 and preferably from about 0.25 to about 0.7. The upper limit of x being less than 0.7 is dictated by electrical conductivity considerations. Thus, a value of x greater than 0.7 may be utilized where only a thin film or surface of the intercalation compound is deposited on the current carrier.

The intercalation compounds of graphite and fluorine useful in the method of this invention generally have electrical resistivities as shown in Table I below.

TABLE I

Electrical Resistivity of Intercalation Compounds of Carbon and Fluorine, [$CF_x$]

| Compound | Bulk Electrical Resistivity (ohm-centimeters) |
|---|---|
| C graphite | $4 \times 10^{-2}$ |
| [$CF_{0.40}$] | 1.59 |
| [$CF_{0.49}$] | 1.93 |
| [$CF_{0.55}$] | 246.0 |
| [$CF_{0.70}$] | $2.1 \times 10^{3}$ |
| [$CF_{0.80}$] | $9 \times 10^{4}$ |
| [$CF_{1.10}$] | $1 \times 10^{9}$ |

The cathodes prepared according to the method of this invention are characterized by a current carrier having on at least a portion thereof the intercalation compound of carbon and fluorine. Additionally, the intercalation compound of carbon and fluorine may have incorporated therein a catalyst for the disproportionation of $HO_2^-$. The current carrier is typically a wire mesh or wire screen in the shape of the desired cathode configuration. The carbon and fluorine are typically applied to the wire mesh or wire screen current carrier as a slurry or paste. The slurry or paste contains the intercalation compound. It may also contain a binder, which binder can have hydrophilic or hydrophobic properties. Typical binder materials are those materials that are resistant to aqueous alkali metal hydroxides having a pH in excess of pH 12 and which serve to impart physical durability to the structure of the intercalation compound on the current carrier. Typical materials useful in providing the binder include finely-divided graphite and finely-divided fluorocarbon polymers such as polyperfluoroethylene, polytrifluoroethylene, polyvinylidene fluoride, polyvinyl fluoride, polychlorotrifluoroethylene, and copolymers thereof. Additionally, there may be graphite present in the paste or slurry as well as cathodic electrocatalysts. The paste of the intercalation compound of carbon and fluorine, graphite, and finely-divided perfluorocarbon polymer is deposited on a metal screen in order to provide the intercalation compound portion of the cathode.

According to one exemplification, a slurry of the intercalation compound and graphite may be mixed with an emulsion of polyperfluoroethylene, which slurry forms a sludge upon the addition of the polyperfluoroethylene. The sludge may then be deposited upon the metal mesh or screen current carrier.

According to a still further exemplification, a liquid composition may be prepared containing the intercalation compound of graphite and fluorine, a small amount of a surfactant, water, and an emulsion of polyperfluoroethylene resin in water. The intercalation compound, the surfactant, the $HO_2^-$ disproportionation catalyst when present, and the water are first admixed together in order to form a slurry. Thereafter, polyperfluoroethylene may be added thereto, forming a sludge which may be deposited on the current carrier.

After deposition of the material on the current carrier, the sludge, paste, or slurry may be dried and compressed whereby to cause the intercalation compound and the binder to adhere to the current carrier. Typically, the heating is carried out at a temperature high enough to drive off any solvents such as water or organic liquids which may be present. This provides a porous layer on the current carrier. Typically, the temperature required is from about 100° C. to about 350° C. Additionally, where less porosity is desired, the paste, slurry, or sludge may be pressed or compressed whereby to provide a less porous cathodic surface.

Typical solvents useful in preparing both the layer of the intercalation compound and the layer of the hydrophobic material include water, methanol, ethanol, dimethylformamide, propylene glycol, acetonitrile, and acetone, among others.

The current carrier is fabricated of metal mesh, metal screen, or a shape such as a cylinder or rod. The shapes may be formed of a porous metal. For example, the current carrier may be a screen of nickel, iron, cobalt, copper, or any material substantially resistant to concentrated aqueous alkali metal hydroxides at pH's in excess of 12.

According to a preferred exemplification of this invention, the cathode may be prepared having both hydrophilic and hydrophobic portions. This may be accomplished by providing upon the surface of the current carrier a layer of a hydrophobic material, for example, a layer of polyperfluoroethylene. The layer of the hydrophobic material may be provided by pressing a slurry or paste of finely-divided hydrophobic material such as polyperfluoroethylene, polychlorotrifluoroethylene, or the like in a suitable solvent onto a portion of the current carrier and thereafter heating the carrier to a temperature high enough to drive off the solvent.

Thereafter, the cathode may be utilized as an air cathode or oxygen cathode or even as a cathode for a liquid oxidant, for example, tertiary butyl hydroperoxide, whereby to prepare a useful liquid co-product, for example, tertiary butyl alcohol.

In the commercial electrolysis of alkali metal chlorides to yield chlorine, hydrogen, and alkali metal hydroxide, the alkali metal hydroxide may be sodium chloride or potassium chloride. Most commonly, the alkali metal chloride is sodium chloride.

Where sodium chloride is the alkali metal chloride being electrolyzed, the sodium chloride is fed to the cell as a brine, that is, as an aqueous solution. The brine may be saturated brine, for example, sodium chloride containing from about 315 grams per liter to about 325 grams per liter of sodium chloride, or an unsaturated brine containing less than about 315 grams per liter of sodium chloride, or even a super-saturated brine containing in excess of 325 grams per liter of sodium chloride.

According to one method contemplated herein, the electrolysis is carried out in a diaphragm cell. The diaphragm may, in fact, be an electrolyte permeable diaphragm, for example, as provided by an asbestos diaphragm or a resin-treated asbestos disphragm. Alternatively, the diaphragm may be a microporous diaphragm, for example, provided by a microporous halocarbon. According to a still further exemplification of this invention, the diaphragm may be a permionic membrane substantially impermeable to the passage of electrolyte therethrough but permeable to the flow of cations therethrough, e.g., sodium ion or potassium ion, i.e., being a cation selective permionic membrane. The perm-selective membrane may be provided by a fluorocarbon resin having ion exchange groups thereon. Typically the ion exchange groups are acid groups or salts of acid groups, for example, sulfonyl groups, carboxylic groups, phosphoric groups, phosphonic groups, and the like.

Permeable diaphragms allow the anolyte liquor to percolate through the diaphragm at a high enough rate that convective flow, i.e., hydraulic flow, through the diaphragm to the catholyte liquor exceeds the electrolytic flow of hydroxyl ion from the catholyte liquor through the diaphragm to the anolyte liquor. In this way, the pH of the anolyte liquor is maintained acid and the formation of chlorate ion within the anolyte liquor is suppressed.

Where an electrolyte permeable asbestos diaphragm is used, the catholyte liquor typically contains from about 10 to about 20 weight percent sodium chloride and from about 8 to about 15 weight percent sodium hydroxide.

Where either an electrolyte permeable diaphragm or perm-selective diaphragm is utilized between the anolyte liquor and the catholyte liquor, the cathode reaction has an electrical potential of about 1.1 volts versus a saturated calomel electrode and, as described above, is:

$$2H_2O + 2e^- \rightarrow H_2 + 2OH^-, \quad (2)$$

which is the overall reaction for the adsorption step:

$$H_2O + e^- \rightarrow H_{ads} + OH^- \quad (3)$$

and one of the two alternative hydrogen desorption steps:

$$2H_{ads} \rightarrow H_2, \text{ or} \quad (4)$$

$$H_{ads} + H_2O + e^- \rightarrow H_2 + OH^-. \quad (5)$$

However, utilizing the cathode herein contemplated the following reaction is believed to take place at the cathode:

$$O_2 + 2H_2O + 4e^- \rightarrow 4OH^-. \quad (6)$$

This reaction is postulated to be an electron transfer reaction;

$$O_2 + H_2O + 2e^- \rightarrow HO_2^- + OH^- \quad (7)$$

followed by a surface reaction;

$$2HO_2^- \rightarrow O_2 + 2OH^-. \quad (8)$$

It is believed that the predominant reaction on the surface of the intercalation compound of carbon and fluorine is reaction (7), with reaction (8) occurring on the surfaces of the catalyst particles dispersed in and through the cathode. Such catalyst particles include particles of electrocatalysts as described hereinbelow. In this way, the high overvoltage hydrogen desorption step is eliminated.

According to one exemplification of the method of this invention, the oxidant is added directly to the catholyte liquor. This may be done by feeding the oxidant directly into the catholyte liquor as through a conduit or downcomer or inlet pipe. When the oxidant is so added, it is added either below the surface of the catholyte liquor or above the surface of the catholyte liquor, for example, through an upward extending pipe in the bottom of the catholyte chamber with a sparger or distributor cap or bubble cap on top or through a downcomer extending into the catholyte liquor with sparger or distributor on the bottom or outlet thereof.

According to an alternative exemplification of the method of this invention, where the diaphragm or permionic membrane is spaced from the cathode, the oxidant may be fed into the electrolyte through a sparger interposed between the cathode and the diaphragm.

According to a preferred exemplification of this invention, the oxidant is fed into the catholyte chamber through the cathode. In such a case, either the hydrophobic portion of the cathode is porous or the current carrier has porous or hollow segments to carry the oxidant. Thus, the cathode geometry may be characterized by surfaces of different characteristics as hereinabove described, with a first hydrophilic portion being wettable by catholyte liquor and intended to be in contact with and completely wetted by the aqueous electrolyte, and a second portion being substantially nonwettable by aqueous catholyte liquor and intended to be in contact with the oxidant.

The oxidant may pass through the hollow or porous cathode and be reduced within the cathode or it may be reduced as it passes from the cathode or boundary layers surrounding the cathode into the catholyte liquor.

The porous portions of the cathode have a porosity of from about 20 to about 80 percent and most commonly from about 45 to about 50 percent. The porous portions of the cathode generally have a mean pore diameter of from about $5 \times 10^{-5}$ inch (1.25 microns) to about $5 \times 10^{-3}$ inch (125 microns) such that the minimum size particle retained therein would be from about $2 \times 10^{-5}$ inch (0.5 micron) to about $2 \times 10^{-3}$ inch (50 microns).

According to one particularly desirable embodiment of the exemplification of this invention where the intercalation compound of carbon and fluorine is a porous material, an $HO_2^-$ disproportionation catalyst is provided within the pores of the porous intercalation compound. According to an alternative exemplification where the intercalation compound is of low porosity or substantially nonporous, the external surfaces of the intercalation compound have the catalyst thereon. According to a still further exemplification of the method of this invention, the hydrophobic portion of the cathode may also be provided with the catalyst in the pores or on the surface thereof.

By $HO_2^-$ disproportionation catalysts are meant those materials that are resistant to attack by the catholyte liquor and capable of catalyzing the reaction:

$$2HO_2^- \rightarrow O_2 + 2OH^-.$$

Typical catalysts include the transition metals of Group VIII, being iron, cobalt, nickel, palladium, ruthenium, rhodium, platinum, osmium, iridium, and compounds thereof. Additionally, other catalysts such as copper, lead and oxides of lead may be used.

Any metal of Group III B, IV B, V B, VI B, VII B, I B, II B, or III A, including alloys and mixtures thereof, which metal or alloy is resistant to the catholyte can be used as the cathode coating or catalyst on the surface of the intercalation compound or within the porous structure of the intercalation compound.

Additionally, solid metalloids, such as phthalocyanines of the Group VIII metals, perovskites, spinels, delafossites, and pyrochlores, among others, may be used as a catalytic surface upon the external surface and within the pores of the intercalation compound.

Particularly preferred catalysts are the platinum group metals, compounds of platinum group metals, e.g., oxides, carbides, silicides, phosphides, and nitrides thereof, and intermetallic compounds and oxides thereof, such as rutile form $RuO_2$-$TiO_2$ having semiconducting properties.

The cathode structure itself may be permeable to the electrolyte or substantially impermeable to the electrolyte. For example, the cathode may be an electrolyte impermeable sheet or plate or the cathode may be impermeable to microscopic flow of electrolyte within the cathode but permeable to macroscopic flow of electrolyte as a layer on a foraminous sheet or layer or film on a plate or wire mesh. According to a still further exemplification, the intercalation compound portion of the cathode may be permeable to the flow of either electrolyte or gases or oxidant as a porous electrode.

According to a still further exemplification of this invention, the cathode may be in the form of packed bed or fluidized bed, for example, a packed or fluidized bed of current carrier particles wherein a portion of a current carrier particle is coated with the intercalation compound of the carbon and fluorine, and another portion of the particle is coated with the hydrophobic material. Alternatively, the entire particle may be formed of the intercalation compound and a portion thereof may be coated with the hydrophobic material. In such an exemplification, the oxidant may be passed directly through the bed, for example, upwardly through the fluidized bed or downward on and through the bed.

In the operation of an electrolytic chlor-alkali cell where an oxidant is added to the cell, the amount of oxidant added is high enough to avoid hydrogen evolution and is preferably at least equal to the stoichiometric amount of oxidant that may be reduced at the cathode, that is, at least one equivalent of oxidant per Faraday of electrolytic current passed through the cell. In order to obtain the stoichiometric amount of oxidant, the feed rate of oxidant should be greater than the stoichiometric demand for oxidant, i.e., greater than the product of the feed rate of chloride to the cell, the fractional decomposition, and the fractional cathode current efficiency of the cell. The feed rate of oxidant is preferably greater than and equal to the product of the feed rate of chloride to the cell and the fractional decomposition. A feed rate of oxidant greater than the product of the feed rate of chloride to the cell, the decomposition, and the current efficiency is generally high enough to avoid gaseous hydrogen evolution on the cathode. Feed rates of oxidant low enough to allow substantial hydrogen evolution should be avoided as such low feed rates will result in an increased voltage and possible decreased current efficiency.

According to one exemplification of this invention, a cathode is prepared by preparing a liquid composition of 10 parts of $[CF_{0.6}]$ having a size range from 0.2 micrometer to 25 micrometers with a predominate size of about 10 micrometers, 1 part of surfactant, 1 part of minus 200 mesh ruthenium dioxide-titanium dioxide particles, and 14 parts of water. To this liquid composition is added 1 part of a 60 weight percent solution of polyperfluoroethylene whereby to form a gummy slurry. The gummy slurry is spread over a nickel wire mesh screen having 0.007 inch diameter nickel wire woven at a 20 mesh by 20 mesh. The screen, with the slurry spread over it, is then pressed between a pair of polyperfluoroethylene coated aluminum plates at a temperature of about 275° C. and a pressure of 3100 pounds per square inch gauge for 10 minutes. After heating, the aluminum plates are removed and a porous polyperfluoroethylene sheet of approximately 34 mils thick and having pores approximately 30 to 60 microns in size is applied to the opposite side of the current carrier. The current carrier is then heated to approximately 190° C. at a pressure of 20 pounds per square inch for approximately 10 minutes to cause the polyperfluoroethylene sheet to adhere thereto.

Thereafter, a $5 \times 5$ mesh polyperfluoroethylene screen is laid atop one side of the current carrier as a separator to separate the current carrier from a sheet of copolymeric perfluoroethylene-perfluorinated alkoxy carboxylic acid as a permionic membrane. The assembly of the current carrier with a polyperfluoroethylene film adhering to one side and the intercalation compound on the opposite side, the spacer, and the permionic membrane is then clamped to the corners of a steel cell box and a titanium-lined steel cell box having a platinized titanium mesh anode therein is bolted to the steel cell box, providing a permionic membraneequipped electrolytic cell having a platinized titanium anode and a cathode with an intercalation compound portion and a polyperfluoroethylene portion.

Aqueous sodium chloride brine is fed to the anolyte compartment while oxygen and water are fed to the catholyte compartment in order to build up the catholyte level and to contact the hydrophobic polyperfluoroethylene surface of the cathode with oxygen. Electrolysis is commenced with chlorine being evolved at the anode and hydroxyl ion being produced in the catholyte liquor.

The following examples are illustrative.

EXAMPLE 1

An air cathode was prepared and utilized as a cathode in a laboratory cell.

A slurry was prepared containing 1.0 grams of Ozark-Mahoning Fluorographite (TM) $[CF_{0.6}]_n$ and 0.15 gram of TRITON ® surfactant in 1.5 grams of water. To this slurry was slowly added 0.2 gram of DuPont TEFLON ® 30B solution of 60 weight percent solid polyperfluoroethylene, thereby forming a gummy paste.

The paste was spread over a 2.5 inch by 2.5 inch nickel wire cloth screen having 0.007 inch diameter nickel wire woven at 20 mesh by 20 mesh. The screen, with the slurry spread over it, was then pressed between two sheets of 0.005 inch thick aluminum sheets which were sandwiched between a pair of polyperfluoroethylene-coated aluminum plates at a temperature of 275° C. and a pressure of 3100 pounds per square inch gauge for 10 minutes. The aluminum was then dissolved off in 2 normal caustic soda and the cathode was dried at a temperature of 80° C. for 60 minutes. Thereafter, a porous polyperfluoroethylene sheet 6.5 mils thick and having 2 to 5 micron pores was applied to one side of the cathode at a temperature of 190° C. and a pressure of 50 pounds per square inch.

The resulting cathode having hydrophilic $[CF_{0.6}]_n$ in and on one side of a nickel screen current collector and hydrophobic polyperfluoroethylene on the opposite side of the nickel screen current collector was utilized as an air cathode in a laboratory electrolytic cell containing a 1 normal NaOH electrolyte. An electrical current was passed from an anode of the cell to a cathode of the cell, oxygen was bubbled along the polyperfluoroethylene surface of the cathode, and gas was seen to be evolved at the anode of the cell. The results shown in Table II below were obtained.

TABLE II

| Cathode Current Density (amperes per square foot) | Cathode Voltage (versus saturated calomel electrode) | Cumulative Time (minutes) |
|---|---|---|
| 25 | −1.36 | 0.16 |
| 25 | −1.15 | 1 |
| 25 | −1.04 | 5 |
| 10 | −0.72 | 6 |
| 50 | −1.38 | 6 |
| 25 | −1.01 | 15 |
| 25 | −0.92 | 25 |
| 25 | −0.93 | 35 |
| 25 | −0.92 | 60 |
| 25 | −0.84 | 90 |
| 25 | −0.91 | 120 |
| 10 | −0.76 | 180 |
| 25 | −1.05 | 180 |
| 50 | −1.29 | 180 |

EXAMPLE 2

An air cathode was prepared and utilized as a cathode in a laboratory cell.

A slurry was prepared containing 1.0 gram of Ozark-Mahoning Fluorographite (TM) $[CF_{0.4}]_n$ and 0.15 gram of TRITON ® surfactant in 1.4 grams of water. To this slurry was slowly added 0.1 gram of DuPont TEFLON ® 30B solution of 60 weight percent solid polyperfluoroethylene forming a gummy paste.

The paste was spread over a 2.5 inch by 2.5 inch nickel wire cloth screen having 0.007 inch diameter nickel wire woven at 20 mesh by 20 mesh. The screen with the paste spread over it was then pressed between a pair of polyperfluoroethylene coated aluminum plates at a temperature of 275° C. and a pressure of 2450 pounds per square inch gauge for 10 minutes. The aluminum plates were pulled apart.

Thereafter, a porous polyperfluoroethylene sheet 34 mils thick and having 30 to 60 micron pores was applied to one side of the cathode at a temperature of 190° C. and a pressure of 50 pounds per square inch.

The resulting cathode having hydrophilic $[CF_{0.4}]_n$ in and on one side of a nickel screen current collector and hydrophobic polyperfluoroethylene on the opposite side of the nickel screen current collector was utilized as an air cathode in a laboratory electrolytic cell having a 1 normal caustic soda electrolyte. An electrical current was passed from an anode of the cell to a cathode of the cell, oxygen was bubbled along the polyperfluoroethylene surface of the cathode, and gas was seen to be evolved at the anode of the cell. The cathode voltage (versus a saturated calomel reference electrode) current density behavior shown in Table III was observed.

TABLE III

| Cathode Current Density (amperes per square foot) | Cathode Voltage (versus saturated calomel electrode) | Cumulative Time (minutes) |
|---|---|---|
| 10 | −0.820 | 0.5 |
| 25 | −0.990 | 1 |
| 25 | −0.763 | 10 |
| 25 | −0.716 | 30 |
| 25 | −0.710 | 60 |
| 50 | −0.995 | 60 |
| *10 | −0.806 | 61 |
| 10 | −0.645 | 65 |
| 10 | −0.640 | 75 |
| 10 | −0.635 | 85 |
| 25 | −1.024 | 90 |
| 25 | −0.975 | 120 |
| 25 | −0.910 | 165 |
| 25 | −0.912 | 180 |
| 10 | −0.595 | 180 |
| 50 | −1.225 | 180 |

*No current was passed for 16 hours and thereafter electrolysis was resumed.

EXAMPLE 3

An air cathode was prepared and utilized as a cathode in a laboratory cell.

A slurry was prepared containing 1.0 gram of Ozark-Mahoning Fluorographite (TM) $[CF_{0.5}]_n$ and 0.15 gram of TRITON ® surfactant in 1.4 grams of water. To this slurry was slowly added 0.1 gram of DuPont TEFLON ® 30B solution of 60 weight percent solid polyperfluoroethylene forming a gummy paste.

The paste was spread over a 2.5 inch by 2.5 inch nickel wire cloth screen having 0.007 inch diameter nickel wire woven at 20 mesh by 20 mesh. The screen was then air dried at 80° C. for 16 hours. The screen, with a dry slurry spread over it, was pressed between a pair of polyperfluoroethylene-coated aluminum plates at a temperature of 275° C. and a pressure of 1750 pounds per square inch gauge for 10 minutes. After cooling, the aluminum plates were removed. Thereafter, a porous polyperfluoroethylene sheet 6.5 mils thick and having 2 to 5 micron pores was applied to one side of the cathode at a temperature of 190° C. and a pressure of 50 pounds per square inch.

The resulting cathode, having hydrophilic $[CF_{0.5}]_n$ in and on one side of a nickel screen current collector and hydrophobic polyperfluoroethylene on the opposite side of the nickel screen current collector was utilized as an air cathode in a laboratory electrolytic cell having a 1 normal caustic soda electrolyte. An electrical current was passed from an anode of the cell to a cathode of the cell, oxygen was bubbled along the polyperfluoroethylene surface of the cathode, and gas was seen to be evolved at the anode of the cell. The cathode voltage (versus a saturated calomel reference electrode) current density behavior shown in Table IV was observed.

TABLE IV

| Cathode Current Density (amperes per square foot) | Cathode Voltage (versus saturated calomel electrode) | Cumulative Time (minutes) |
|---|---|---|
| 10 | −1.23 | 0.5 |
| 10 | −1.10 | 5 |
| 10 | −0.84 | 30 |
| 10 | −0.84 | 60 |
| 10 | −0.84 | 120 |
| 20 | −1.19 | 120 |
| 10 | −0.74 | 240 |
| 20 | −1.04 | 240 |

Although this invention has been described with respect to certain specific exemplifications and embodiments, it is not intended that it be so limited except as appears in the attached claims.

I claim:

1. In a method of conducting electrolysis comprising passing an electrical current from an anode through an aqueous electrolyte to a cathode, the improvement wherein said cathode comprises an intercalation compound of carbon and fluorine.

2. The method of claim 1 wherein said cathode has a hydrophilic portion in contact with the aqueous electrolyte and a hydrophobic portion in contact with gas and wherein said hydrophilic portion comprises the intercalation compound of carbon and fluorine.

3. The method of claim 2 wherein the aqueous electrolyte in the hydrophilic portion of the cathode is alkaline.

4. The method of claim 3 wherein the alkaline aqueous electrolyte comprises alkali metal ions.

5. The method of claim 2 wherein the gas in contact with the hydrophobic portion of the cathode is an oxidizing gas.

6. The method of claim 5 wherein the oxidizing gas comprises oxygen.

7. The method of claim 1 wherein the intercalation compound of carbon and fluorine has the empirical formula $CF_x$ where x is between 0.25 and 1.0.

8. The method of claim 1 wherein said cathode comprises a $HO_2^-$ disproportionation catalyst.

9. In the method of electrolyzing an aqueous alkali metal halide brine comprising passing an electrical current from an anode in aqueous alkali metal halide brine through the brine to a permeable barrier, through the permeable barrier to an aqueous alkaline electrolyte, and through the aqueous alkaline electrolyte to a cathode in contact with the aqueous alkaline electrolyte and recovering halogen and an aqueous solution comprising alkali metal hydroxide, the improvement wherein said cathode comprises a solid intercalation compound of carbon and fluorine.

10. The method of claim 9 wherein said alkali metal halide is chosen from the group consisting of sodium chloride and potassium chloride.

11. The method of claim 9 wherein said permeable barrier is a cation permeable, electrolyte impermeable membrane.

12. The method of claim 9 wherein said permeable barrier is an electrolyte permeable diaphragm.

13. The method of claim 9 comprising contacting said cathode with an oxidant.

14. The method of claim 13 wherein said cathode has a hydrophobic portion and a hydrophilic portion comprising the solid intercalation compound of carbon and fluorine.

15. The method of claim 9 wherein the cathode comprises a current carrier in contact with the intercalation compound of carbon and fluorine.

16. The method of claim 9 wherein the solid intercalation compound of carbon and fluorine has the empirical formula $CF_x$ where x is between 0.25 and 0.70.

17. The method of claim 9 wherein the cathode comprises an $HO_2^-$ disproportionation catalyst.

18. An electrode comprising a current carrier, a hydrophilic first external surface portion on said current carrier and a hydrophobic second external surface portion on said current carrier, said first external surface portion comprising a solid intercalation compound of carbon and fluorine and an $HO_2^-$ disproportionation catalyst, and said second external surface portion comprising a hydrophobic fluorocarbon resin surface.

19. The cathode of claim 18 wherein the solid intercalation compound of carbon and fluorine has the empirical formula $CF_x$ where x is between 0.25 and 0.70.

* * * * *